US011205868B2

(12) United States Patent
Domergue et al.

(10) Patent No.: US 11,205,868 B2
(45) Date of Patent: Dec. 21, 2021

(54) CONNECTOR WITH TWO DIRECTIONS OF MOVEMENT OF THE TERMINAL POSITION ASSURANCE DEVICE

(71) Applicant: APTIV TECHNOLOGIES LIMITED, St. Michael (BB)

(72) Inventors: Lionel Domergue, Colombes (FR); Sylvain Loas, Louveciennes (FR)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 0 days.

(21) Appl. No.: 16/810,173

(22) Filed: Mar. 5, 2020

(65) Prior Publication Data

US 2020/0287314 A1 Sep. 10, 2020

(30) Foreign Application Priority Data

Mar. 7, 2019 (FR) ..... 1902350

(51) Int. Cl.
*H01R 13/506* (2006.01)
*H01R 13/436* (2006.01)

(52) U.S. Cl.
CPC ..... *H01R 13/4362* (2013.01); *H01R 13/506* (2013.01)

(58) Field of Classification Search
CPC ..... H01R 13/4362; H01R 13/506
See application file for complete search history.

(56) References Cited

U.S. PATENT DOCUMENTS 5,100,345 A * 3/1992 Endo ..... H01R 13/506 439/592
5,316,504 A * 5/1994 Jinno ..... H01R 13/4362 439/595
5,378,176 A * 1/1995 Sasai ..... H01R 13/4362 439/752
5,460,550 A * 10/1995 Okayasu ..... H01R 13/4362 439/752
5,651,703 A 7/1997 Sasai
5,730,627 A * 3/1998 Okabe ..... H01R 13/4362 439/752

(Continued)

FOREIGN PATENT DOCUMENTS

EP 0390006 A1 3/1990
JP H02183978 7/1990

OTHER PUBLICATIONS

Search Report for French Application No. FR 1902350 dated Nov. 25, 2019.

(Continued)

*Primary Examiner* — Tho D Ta
(74) *Attorney, Agent, or Firm* — Carlson, Gaskey & Olds, P.C.

(57) ABSTRACT

An example connector includes a housing made of a dielectric material, in which cells are formed. Terminals are housed in the cells and extend essentially in a longitudinal direction. The housing is also equipped with a terminal position assurance device having locking means interacting with a stop surface located on the terminal. The terminal position assurance device may possibly have a system of ramps arranged to move the locking means sequentially, perpendicularly to the longitudinal direction, and then parallel to the longitudinal direction. The leakage path between two terminals can then be lengthened.

11 Claims, 7 Drawing Sheets

(56) References Cited

U.S. PATENT DOCUMENTS

| | | | | |
|---|---|---|---|---|
| 5,769,670 | A * | 6/1998 | Abe | H01R 13/4362 439/752 |
| 5,865,653 | A * | 2/1999 | Okada | H01R 13/4362 439/752 |
| 9,666,970 | B2 * | 5/2017 | Kida | H01R 13/5219 |
| 10,348,019 | B1 * | 7/2019 | Hocevar | H01R 13/4361 |
| 2002/0086588 | A1 * | 7/2002 | Fujita | H01R 13/4362 439/752 |
| 2006/0025022 | A1 * | 2/2006 | Ishikawa | H01R 13/4362 439/752 |
| 2020/0395705 | A1 | 12/2020 | Kot | |

OTHER PUBLICATIONS

First Office Action for Chinese Application No. 202010150261.7 dated Feb. 26, 2021.

* cited by examiner

CONNECTOR WITH TWO DIRECTIONS OF MOVEMENT OF THE TERMINAL POSITION ASSURANCE DEVICE

CROSS-REFERENCE TO RELATED APPLICATIONS

This application claims priority to French Application No. FR1902350, filed on Mar. 7, 2019.

TECHNICAL FIELD

The invention relates to the field of connector technology. For example, the invention may be applied in connector technology for motor vehicles.

PRIOR ART

The connector technology industry frequently follows a common trend of designing increasingly miniaturized devices. In the field of connector technology, miniaturization usually goes hand in hand with increasing terminal density. In other words, the coupling interfaces of connectors comprise an increasing density of connection points, and the terminals are housed increasingly close to each other in the connector housings.

However, even in miniaturized connectors it may be useful to retain means for ensuring that the terminals have been correctly inserted and housed in their respective cells. Consequently, some prior art connectors 1, such as those shown in FIG. 1, are equipped with a terminal position assurance device 2 (or a "TPA" device). In this case, a groove 3 is formed in the housing 4, perpendicularly to the longitudinal direction L of the terminals 5. An element 6 (in the form of a bar or beam, for example) of the terminal position assurance device 2 is then introduced into this groove 3. If the terminal 5 is incorrectly positioned in its cell 7, it will at least partially obstruct the groove 3 and prevent this element 6 from being inserted behind a stop surface 8 of the terminal 5. Conversely, if the terminal 5 is correctly positioned in its cell 7 (as in FIG. 1), this element 6 will be inserted behind the stop surface 8 of the terminal 5. Thus, not only does this element 6 of the terminal position assurance device 2 make it possible to ensure the correct positioning of the terminal 5 in its cell 7, but it also locks the terminal 5 in its cell 7, preventing it from leaving its cell 7 if tension is applied to a portion of the terminal 5 connected to a cable.

But, as may be seen in FIG. 1, in order for the terminal position assurance device 2 to be guided in a precise way (and therefore with a limited clearance) in the groove 3, and for the movement of the terminal 5 to be limited in the longitudinal direction L, the stop surface 8 of the terminal 5 lies flush in the groove 3. The distance GA separating the stop surface 8 from the terminal position assurance device 2 is essentially zero. The distance between two neighbouring terminals is then essentially equal to the distance SD separating two neighbouring cells (see FIG. 2). With a high terminal density, this distance SD may be reduced to less than 400 micrometres. This may result in an excessively low dielectric strength and leakage paths.

SUMMARY OF THE INVENTION

In an illustrative example embodiment, a connector includes a housing made of a dielectric material. This housing comprises at least two cells, in each of which a terminal is housed. Each terminal extends essentially in a longitudinal direction, corresponding to the direction of insertion of a terminal into its cell, and, when the terminal is housed in the cell, to the longitudinal direction of the cell. This housing is also equipped with a terminal position assurance device. This terminal position assurance device comprises locking means. This terminal position assurance device may occupy a locking position. The locking means are then adapted to interact, when the terminal position assurance device is in this locking position, with a stop surface located on each of the terminals.

The terminal position assurance device further comprises guide means for moving the locking means sequentially, perpendicularly to the longitudinal direction, and then in a movement having a component parallel to the longitudinal direction. During their movement perpendicularly to the longitudinal direction, the locking means are inserted at the position of the cells, facing the stop surfaces. During their movement having a component parallel to the longitudinal direction, the locking means are brought towards the stop surfaces or even come into contact with them.

It is no longer necessary for the stop surface of a terminal to lie flush in a groove, since the locking means can be brought towards the stop surface during a movement which is not solely transverse. The movement which brings the locking means towards the stop surfaces may be a purely rectilinear movement, or may correspond to a rotation or a cam-type movement. In all cases, it comprises at least one component parallel to the longitudinal direction of the terminals and of their respective cell.

This connector may also have at least one of the following characteristics, considered independently of the others or in combination with one or more others:

two cells are separated by a partition extending longitudinally from a rear end toward a front face of the connector, and the locking means corresponding to each of the terminals housed in the cells penetrate, when the terminal position assurance device is in the locking position, into the cells in the longitudinal direction, toward the front face of the connector and beyond the rear end of the partition;

the locking means comprise at least two protuberances separated by a space, the protuberances then each penetrate, when the terminal position assurance device is in the locking position, into a respective cell, and the rear end of the partition is received in the space between the protuberances;

the protuberances extend, from a surface located at the position of said space, over a distance greater than or equal to 100 micrometres;

the terminal position assurance device comprises a system of ramps having surfaces inclined relative to the longitudinal direction and moving the locking means toward the front face of the connector, when the terminal position assurance device is moved toward its locking position;

the terminal position assurance device comprises two elements, namely a pushing element and an element carrying the locking means;

the housing comprises a groove extending longitudinally perpendicularly to the longitudinal direction of the cells, and the pushing element is guided in the groove in a movement perpendicular to the longitudinal direction of the cells;

the pushing element comprises a central rib extending longitudinally perpendicularly to the longitudinal direction of the cells, and the element carrying the locking means comprises two lateral beams, each extending longitudinally, respectively, on either side of, and along, the central rib; and it comprises at least two cells separated by a distance, perpendicularly to the longitudinal direction, which is less than or equal to 400 micrometres, the locking means penetrating into these cells.

BRIEF DESCRIPTION OF THE DRAWINGS

Other characteristics, objects and advantages of embodiments of the invention will become apparent from the following detailed description, with reference to the attached drawings provided as non-limiting examples, in which.

DETAILED DESCRIPTION

The terms "top", "bottom", "front", "rear", etc., used in this document essentially correspond to convention (the front of a connector corresponds to its coupling face, for example) and/or to the orientation of the various elements as they are shown in the figures.

An example embodiment of a connector 1 according to an embodiment of the invention is described below.

According to this example, the connector 1 is female, but the description is equally applicable to a male connector.

Figure 2:
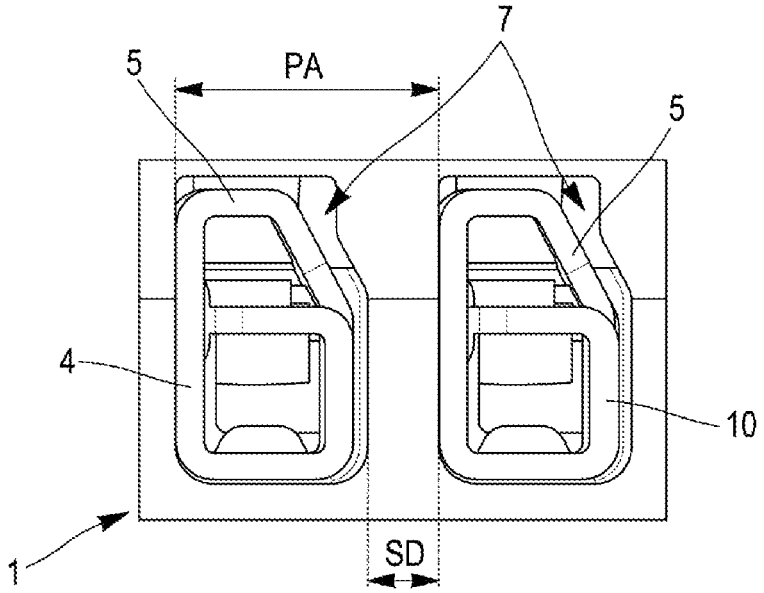
FIG. 2 shows schematically, in transverse section, two neighbouring cells of an example of embodiment of a connector.

This connector 1 comprises a housing 4 made by moulding from a dielectric plastic resin. This housing 4 comprises a plurality of cells 7, each housing a terminal 5. For example, the housing 4 comprises eight cells 7 arranged in two rows of four cells. In FIG. 2, a part of the housing 4 comprising only two cells 7 is shown. Each cell 7 extends longitudinally in a longitudinal direction essentially perpendicular to the plane of the sheet on which FIG. 2 is presented. The two neighbouring cells 7 shown are aligned horizontally with an interval PA of 1.5 millimetres. Two other cells are aligned in the same direction to form a row with four cells 7 spaced at the same interval PA from one another. Another row is arranged parallel to the latter, with four cells 7 arranged symmetrically relative to a median plane parallel to the longitudinal direction of the cells 7 (see FIGS. 4 and 6). The cells 7 of one row are therefore located facing the cells of the other row relative to this plane of symmetry. Two cells 7 symmetrical to one another relative to this plane are aligned in a direction which is perpendicular to both the longitudinal direction of the cells 7 and the direction parallel to the rows.

These two cells 7 are separated from one another by a partition 9. A terminal 5 is housed in each cell 7. The distance SD separating the two terminals 5 shown on either side of the partition 9 is less than or equal to 400 micrometres.

Each terminal 5 comprises a cage 10 designed to receive a pin of a male terminal (not shown).

Figure 1:
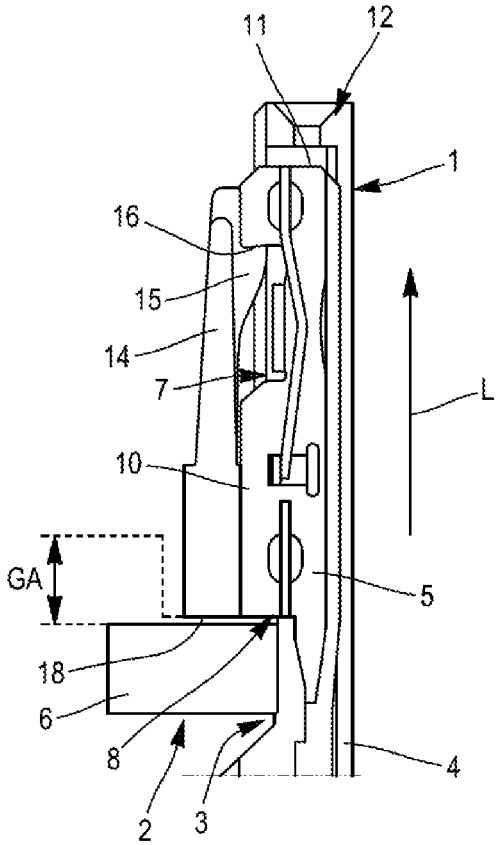
FIG. 1 (PRIOR ART)
FIG. 1 shows schematically, in longitudinal section, the cell of a connector, the connector being provided with a terminal position assurance device, according to the prior art.
Figure 3:
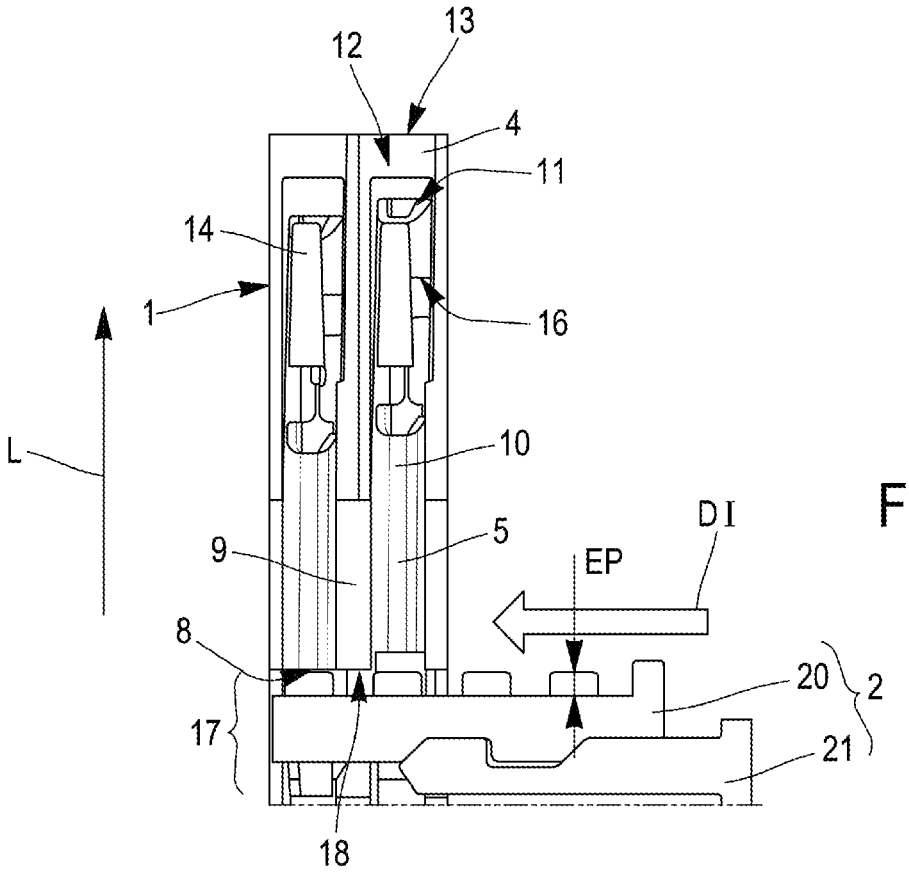
FIG. 3 shows schematically, in transverse section and in a top view, two neighbouring cells of a connector such as that shown in FIG. 1 or FIG. 2, the connector being provided with a terminal position assurance device according to the invention.

As shown in FIG. 1 or FIG. 3, the cage 10 extends essentially in a longitudinal direction L between a free end 11 and a stop surface 8. In a known way, each terminal 5 is held in its respective cell 7, in the forward direction by a front grid 12 formed on the front face 13 of the connector 1, and in the backward direction by means of a latch 14 made in one piece with the housing 4. Each latch 14 comprises a tooth 15, and returns resiliently so that the tooth 15 is housed behind a catch 16 formed on the terminal 5 when the terminal 5 is correctly positioned in its cell 7. Thus the latch 14 and the catch 16 form, in a known way, primary locking means.

The length LC of the cage 10 between its free end 11 and the stop surface 8 is less than the distance LA between the inner face of the front grid 12 and a rear end 18 of the partition 9 located opposite the latch 14. In other words, if the cage 10 bears on the inner face of the front grid 12, the stop surface 8 is shifted forwards relative to the end of the partition 9 located opposite the latch 14.

Behind the cage 10, between the cage 10 and a fixing portion (for example, a crimping portion for attaching and connecting a cable to the terminal), the terminal 5 has a narrower intermediate portion 17.

The housing 4 is also equipped with a terminal position assurance device 2. As shown in FIG. 3, the terminal position assurance device 2 comprises two elements 20, 21, arranged one on top of the other. These elements 20, 21 are inserted as slide-in units into a groove 3 formed in the housing 4, and slide transversely perpendicularly to the longitudinal direction L of the terminals 5. These elements 20, 21 thus become housed behind the stop surface 8 of each terminal 5, at the position of its intermediate portion 17.

The two elements 20, 21 of the terminal position assurance device 2 correspond, respectively, to an element carrying the locking means 20 and a pushing element 21.

Figure 7:
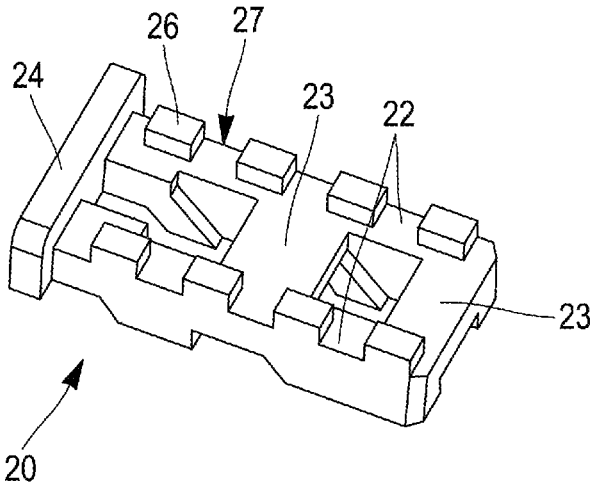
FIG. 7 shows schematically, in perspective and in a top view, an example of embodiment of an element carrying the locking means, forming part of a terminal position assurance device in a locking position, for a connector such as that shown in FIGS. 2 to 6.
Figure 8:
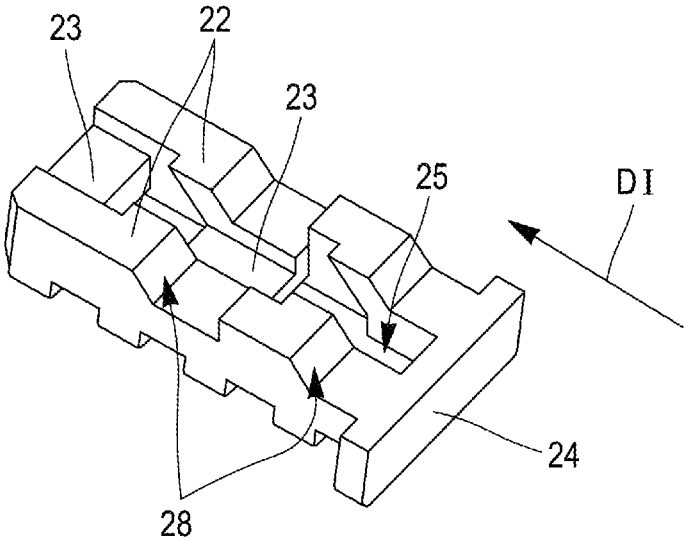
FIG. 8 shows schematically, in perspective and in a bottom view, the element carrying the locking means shown in FIG. 7.

The element carrying the locking means 20 is shown in greater detail in FIGS. 7 and 8. It comprises, for example, two lateral beams 22 interconnected by cross-pieces 23 and a graspable front piece 24 extending at one of the ends of the beams 22, in a plane perpendicular to the longitudinal direction of the beams 22. The longitudinal direction of the beams 22 corresponds to a direction of insertion and translation of the elements 20, 21 in the housing 4. A channel 25 extends between the two beams 22, parallel to the latter.

Locking means 26 are arranged on the top of each beam 22 (FIG. 7). These means are formed by protuberances 26. For example, each beam 22 comprises four protuberances 26. The respective numbers of beams 22 and protuberances 26 correspond to the example (a female connector with eight terminals) chosen to illustrate the invention, and are not to be considered as limiting.

Each protuberance 26 is parallelepipedal in shape. The protuberances 26 form notches on the top of each beam 22. Thus there is a space between two neighbouring protuberances 26. As explained below, this space may be used to receive the rear end 18 of a partition 9. The protuberances 26 extend from the upper surface of the beam 22 over a distance EP which is greater than or equal to 100 micrometres (see FIG. 3). For example, the distance EP is 400 micrometres.

At least two ramps 28 are present on the bottom of each beam 22 (FIG. 8). Each ramp 28 comprises a surface which is inclined relative to a direction DI of insertion and translation of the elements 20, 21 in the housing 4. Each inclined surface is oriented, on the one hand, so as to form an open angle (greater than 90°) with the bottom of the beam 22, and, on the other hand, towards the outside of the connector 1 (to facilitate this referencing, the front piece 24 must be considered to be on an outer face of the connector 1).

Figure 9:
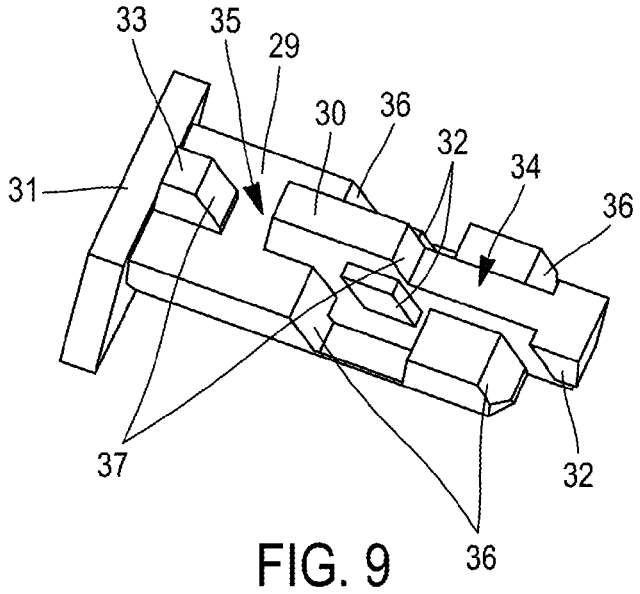
FIG. 9 shows schematically, in perspective and in a top view, an example of embodiment of a pushing element, forming part of a terminal position assurance device in a locking position, for a connector such as that shown in FIGS. 2 to 6.
Figure 10:
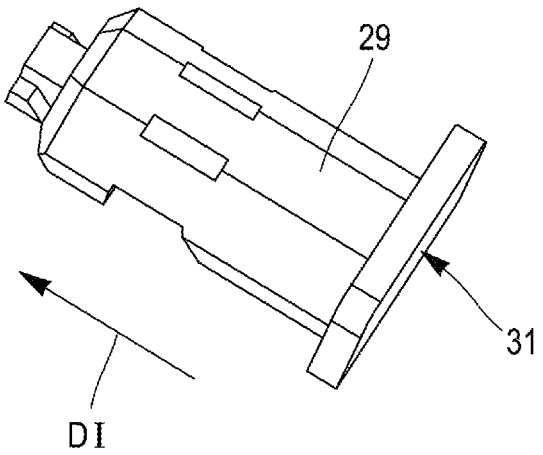
FIG. 10 shows schematically, in perspective and in a bottom view, the pushing element shown in FIG. 9.

The pushing element 21 is shown in greater detail in FIGS. 9 and 10. It comprises, for example, a body 29, a central rib 30 and a graspable front piece 31. The rib 30 extends essentially in the longitudinal direction of the body 29. The longitudinal direction of the body, in the example chosen to illustrate the invention, corresponds to the direction DI of insertion and translation of the elements 20, 21 in the housing 4. The front piece 31 extends, at one of the ends of the body 29, in a plane perpendicular to the longitudinal direction of the body.

The rib 30 is designed to be engaged and to slide in the channel 25. On either side of the rib 30, on its lateral faces, there are jamming means 32 designed to be inserted forcibly into certain areas of the channel 25 in order to keep the element carrying the locking means 20 and the pushing element 21 together, notably in an assembled position. The rib 30 also comprises a locking catch 33 near the front piece 31.

The rib 30 comprises a front notch 34 and a rear notch 35. The front notch 34 is adapted to receive one of the cross-pieces 23, while the element carrying the locking means 20 and the pushing element 21 are mounted on one another in the assembled position. The rear notch 35 is adapted to receive the front piece 24 of the element carrying the locking means 20, when the element carrying the locking means 20 and the pushing element 21 are mounted on one another in the assembled position.

The body 29 comprises at least two lateral ramps 36 arranged on either side of the rib 30 and two central ramps 37 arranged on the rib 30. Each ramp 36, 37 of the body 29 is designed to interact with a ramp 28, a cross-piece 23 or the front piece 24 of the element carrying the locking means 20.

Each ramp 36, 37 of the body 29 comprises a surface which is inclined relative to the direction DI of insertion and translation of the elements 20, 21 in the housing 4. Each inclined surface is oriented, on the one hand, so as to form an open angle with the top of the body 29, and, on the other hand, towards the inside of the connector 1 (therefore facing in a direction which is essentially opposite that towards which the front piece 31 is located).

An example of a method for assembling the connector 1 according to the invention is described below.

Figure 11:
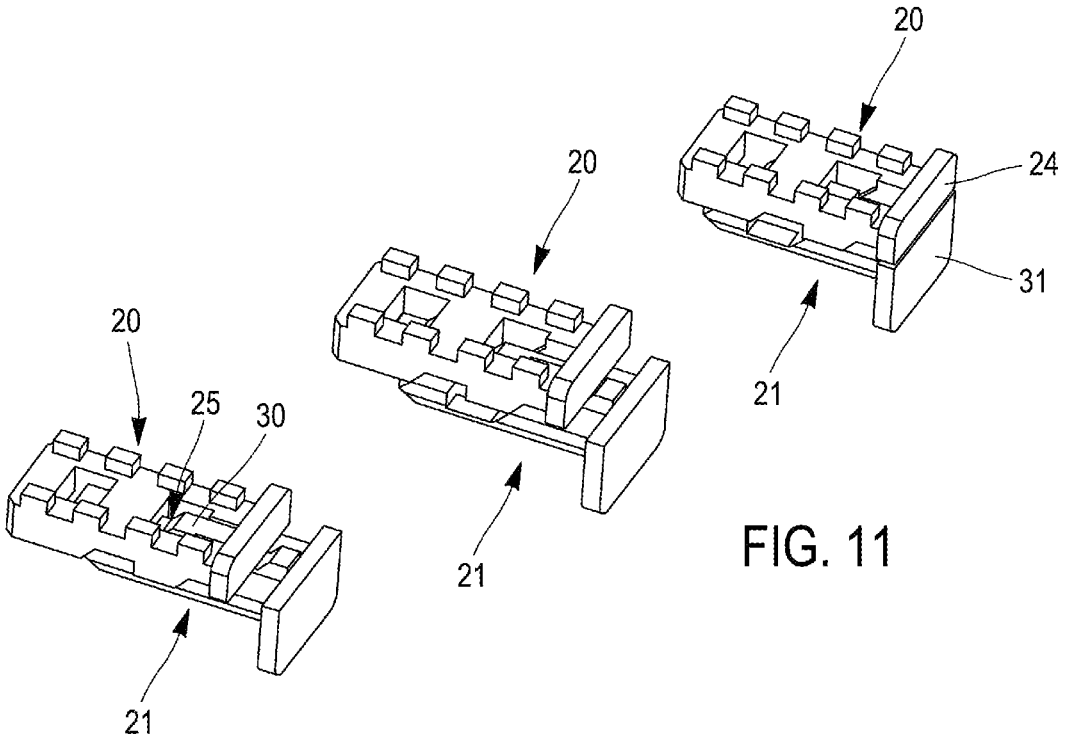
FIG. 11 shows schematically, in perspective, the element carrying the locking means and the pushing element shown in FIGS. 7 to 10, these elements being assembled in three positions differing from one another.
Figure 12:
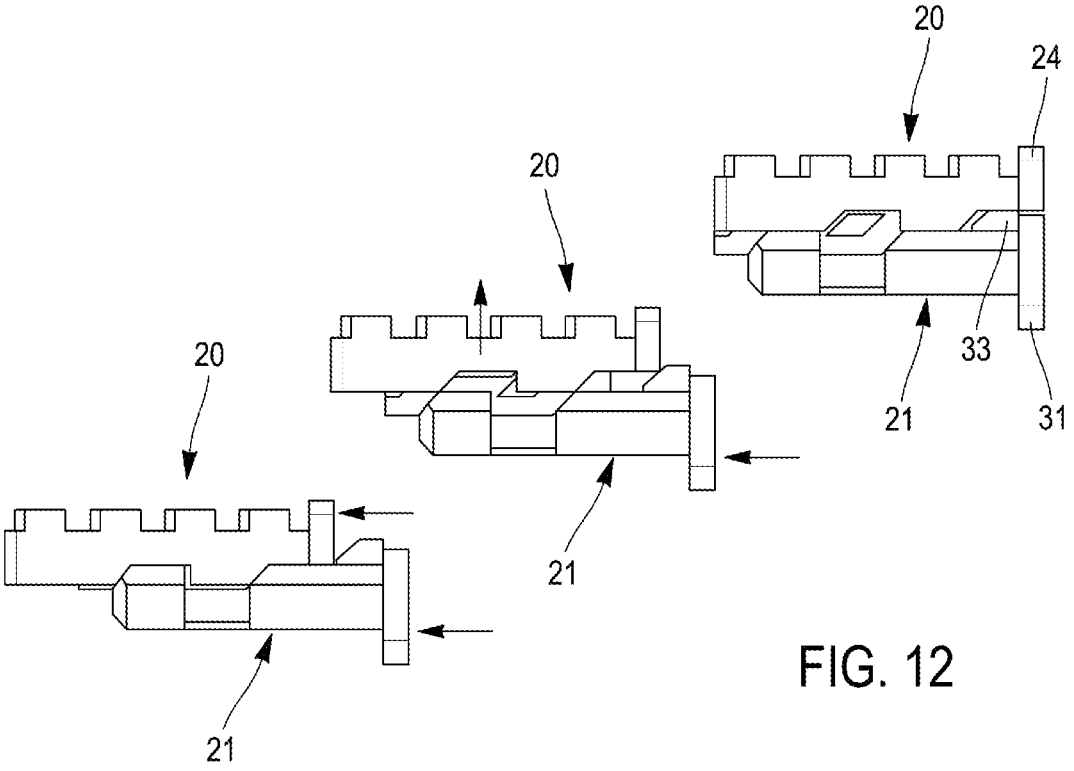
FIG. 12 shows schematically, in a side elevation, the element carrying the locking means and the pushing element in the three positions shown in FIG. 11.
Figure 13:
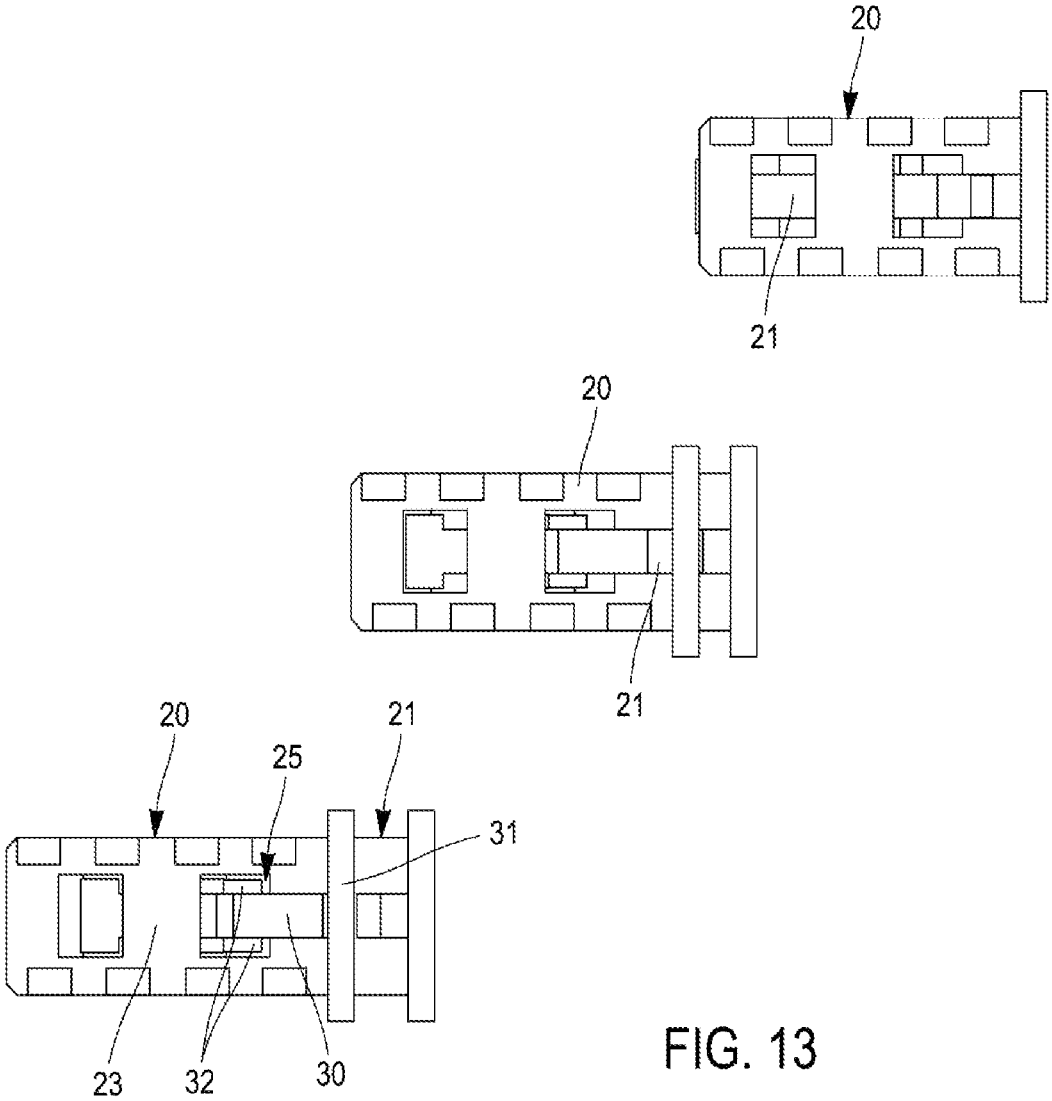
FIG. 13 shows schematically, in a top view, the element carrying the locking means and the pushing element in the three positions shown in FIGS. 11 and 12.

On the one hand, the element carrying the locking means 20 and the pushing element 21 are mounted on one another in the aforementioned assembled position (see the left-hand drawing in FIGS. 11, 12 and 13). The rib 30 is engaged in the channel 25. The jamming means 32 interact with lateral areas of the channel 25 in order to keep the element carrying the locking means 20 and the pushing element 21 together. A cross-piece 23 is received in the front notch 34. The front piece 31 of the element carrying the locking means 20 is received in the rear notch 35. The inclined surfaces of the system of ramps 28, 36 rest on one another. The assembly formed by the element carrying the locking means 20 and the pushing element 21, mounted on one another, thus forms a terminal position assurance device 2.

The terminals 5 are also inserted into their respective cells 7.

Figure 4:
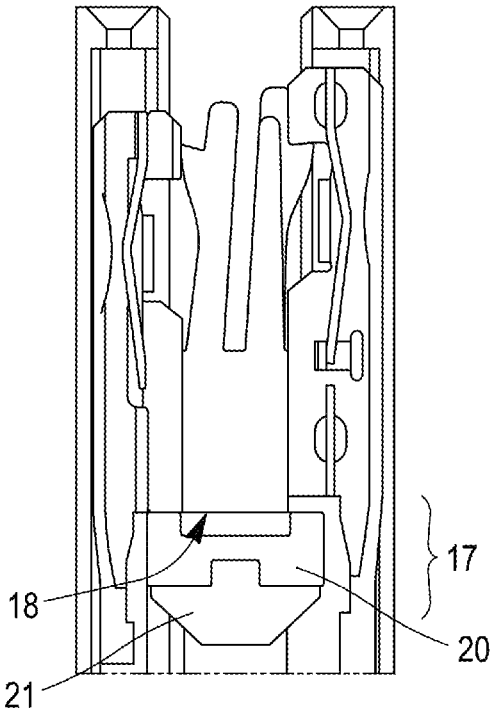
FIG. 4 shows schematically, in a transverse section and in a side view, two cells of the connector shown in FIGS. 2 and 3, with terminals each being correctly positioned in a respective one of these two cells.

The terminal position assurance device 2 is then introduced into the groove 3, so that it can be moved towards its locking position (FIGS. 3 to 6). If a terminal 5 is not sufficiently well inserted into its cell 7, it interferes with the terminal position assurance device 2 when the latter is moved in the groove 3 (see FIG. 5). The operator is therefore alerted to the problem and can resolve it. When all the terminals 5 of the connector 1 are sufficiently well positioned, even if some of them have not yet moved forwards sufficiently for primary locking to be provided by the corresponding latch 14 (FIG. 4), the operator can push the terminal position assurance device 2, by pressing on the front piece 31 of the pushing element 21, into its locking position (FIG. 3). Since the respective inclined surfaces of the element carrying the locking means 20 and the pushing element 21 rub on one another, the front piece 24 of the element carrying the locking means 20 and the cross-piece 23 are engaged in their respective notches 34, 35, and the jamming means 32 keep these two elements 20, 21 together, a moderate pressure on the front piece 31 of the pushing element 21 enables the whole of the terminal position assurance device 2 to be inserted until it reaches its locking position (FIG. 4). At the same time, the element carrying the locking means 20 and the pushing element 21 are pushed in a direction perpendicular to the longitudinal direction L of the terminals (left-hand drawing in FIGS. 11, 12 and 13).

At this stage, the protuberances 26 of the locking means are located facing the stop surfaces 8 (FIG. 4). The front piece 24 of the element carrying the locking means 20 is at the position of the outer face of the connector 1 onto which the terminal position assurance device 2 has been introduced.

Figure 5:
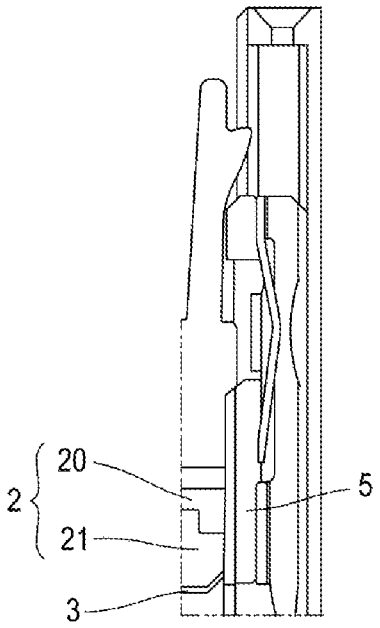
FIG. 5 shows schematically, in a transverse section and in a side view, a cell of the connector shown in FIGS. 2 to 4, a terminal being incorrectly positioned in its cell.
Figure 6:
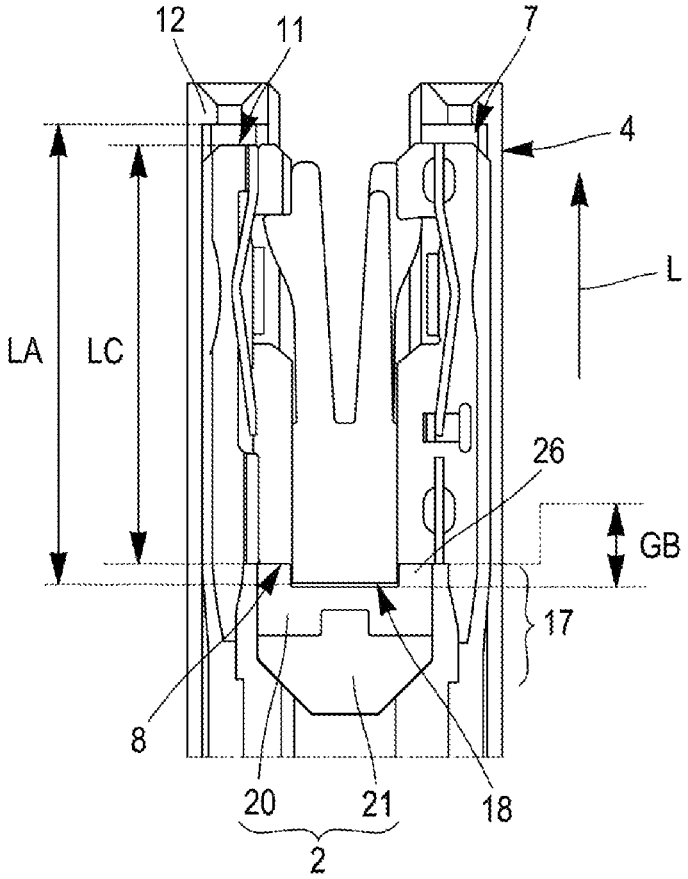
FIG. 6 is a view similar to that of FIG. 4, with a terminal position assurance device in a locking position.

The operator then presses slightly more strongly on the front piece 31 of the pushing element 21, and the respective inclined surfaces of the element carrying the locking means 20 and the pushing element 21 cause the element carrying the locking means 20 to rise relative to the pushing element 21 (see FIG. 5). During this movement perpendicular to the longitudinal direction L of the terminals 5, the locking means (the protuberances 26) are moved with a component parallel to the longitudinal direction L of the terminals 5 (middle drawing in FIGS. 11, 12 and 13). They are brought towards the stop surfaces 8. The jamming means 32 escape from the channel 25 and become inoperative. If some of the terminals 5 have not yet been moved forwards sufficiently for primary locking to be provided by the corresponding latch 14, the protuberances 26 of the locking means may push them forwards in their respective cells 7, and thus eventually complete a primary locking with a latch 14 (FIG. 6). The distance GB between the stop surface 8 and the rear end 18 of the partition 9 is greater than or equal to 100 micrometres. Consequently, the leakage path between two neighbouring terminals 5 is at least 400 micrometres, plus 100 micrometres for each terminal, that is to say at least 600 micrometres. The dielectric strength of the connector 1 is therefore increased.

By pressing the front piece 31 of the pushing element 21 a little farther, the operator brings the front piece of the pushing element 21 to the same level as the front piece 24 of the element carrying the locking means 10. The front piece 24 of the element carrying the locking means 20 is locked behind the locking catch 33. The terminal position assurance device 2 is then in the locking position (right-hand drawings in FIGS. 11, 12 and 13). The protuberances 26 of the locking means are engaged in the cells 7 into which they have penetrated, beyond the rear end 18 of the partition 9, towards the front face 13 of the connector. Consequently, the protuberances 26 lock each terminal 5 in its respective cell 7, thus limiting its movement in the longitudinal direction L.

The rear end 18 of the partition 9 being received in the space between the protuberances 26, the terminal position assurance device 2 is locked in translation in the groove 3.

During the assembly described above, the element carrying the locking means 20 and the pushing element 21 are therefore moved sequentially, firstly, together in a direction perpendicular to the longitudinal direction L of the terminals (see the arrows on the left-hand drawing in FIG. 12), and then, secondly, in directions perpendicular to one another (see the arrows on the middle drawing in FIG. 12). The system of ramps 28, 36 thus, notably, provides guide means for moving the locking means 26 sequentially, perpendicularly to the longitudinal direction L, and then in a movement having a component parallel to the longitudinal direction L.

For disassembly, if required, the operator must pull on the front piece 31 of the pushing element 20 (moving it downwards at the same time if necessary), so as to disengage the front piece 24 of the element carrying the locking means 20 from the locking catch 33. An operation which is the reverse of that described above may then be carried out.

A possible advantage of the invention lies in the fact that it is possible to fit a terminal position assurance device 2, formed from two elements 20, 21 such as those described above, on to a connector equipped with a prior art terminal position assurance device. There is no need to modify the housings 4 in order to benefit from the other advantages of the invention.

The invention claimed is:

1. A connector comprising a housing made of a dielectric material, the housing comprising at least two cells, wherein a terminal is housed in each cell, each terminal extending essentially in a longitudinal direction, the housing including a terminal position assurance device having locking means adapted to interact, in a locking position of the terminal position assurance device, with a stop surface located on each of the terminals, the terminal position assurance device including guide means for moving the locking means sequentially, perpendicularly to the longitudinal direction, for inserting the locking means facing the stop surfaces, and then in a movement having a component parallel to the longitudinal direction, for bringing the locking means toward the stop surfaces; and wherein the terminal position assurance device comprises two elements, namely a pushing element and an element carrying the locking means, wherein the pushing element comprises a central rib extending longitudinally perpendicularly to the longitudinal direction of the cells, and the element carrying the locking means comprises two lateral beams, each extending longitudinally, respectively, on either side of, and along, the central rib.

2. The connector according to claim 1, comprising at least two cells aligned parallel to a direction of insertion of the terminal position assurance device into the housing.

3. The connector according to claim 1, wherein the terminal position assurance device comprises a plurality of ramps having surfaces inclined relative to the insertion direction of the terminal position assurance device into the connector housing and moving the locking means toward the front face of the connector, when the terminal position assurance device is moved toward its locking position.

4. The connector according to claim 1, wherein the two cells are separated by a distance, perpendicularly to the longitudinal direction, which is less than or equal to 400 micrometres, the locking means penetrating into the cells.

5. The connector according to claim 1, wherein the two cells are separated by a partition extending longitudinally from a rear end toward a front face of the connector, and wherein the locking means corresponding to each of the terminals housed in the cells penetrate, when the terminal position assurance device is in the locking position, into the cells in the longitudinal direction, toward the front face of the connector and beyond the rear end of the partition.

6. The connector according to claim 5, wherein the locking means comprise at least two protuberances separated by a space, the protuberances each penetrating, when the terminal position assurance device is in the locking position, into a respective cell, and the rear end of the partition being received in the space between the protuberances.

7. The connector according to claim 6, wherein the protuberances extend, from a surface located at the position of said space, over a distance greater than or equal to 100 micrometres.

8. The connector according to claim 1, comprising jamming means which keep the pushing element and the carrying element together in an assembled position.

9. The connector according to claim 8, wherein the housing comprises a groove extending longitudinally perpendicularly to the longitudinal direction of the cells, and the pushing element is guided in the groove in a movement perpendicular to the longitudinal direction of the cells.

10. A method for assembling a connector according to claim 1, inserting the terminal position assurance device into the housing in a direction of insertion perpendicular to the longitudinal direction of the terminals, and moving the terminal position assurance device in the direction of insertion toward a locking position in which the locking means push the terminals into their respective cells.

11. The method according to claim 10, wherein the terminal position assurance device comprises a pushing element and an element carrying the locking means, and wherein moving the terminal position assurance device in the direction of insertion causes a movement of the pushing element and of the carrying element relative to one another with a component in a direction perpendicular to the direction of insertion.

* * * * *